United States Patent [19]

Falterman et al.

[11] 4,047,990

[45] Sept. 13, 1977

[54] PLASTIC BONDED EXPLOSIVE COMPOSITION

[75] Inventors: Charles W. Falterman; Dino A. Sbrocca, both of China Lake, Calif.

[73] Assignee: The United States of America as represented by the Secretary of the Navy, Washington, D.C.

[21] Appl. No.: 659,560

[22] Filed: Aug. 1, 1967

[51] Int. Cl.[2] ..... C06B 45/10

[52] U.S. Cl. ..... 149/19.2; 149/92; 149/105

[58] Field of Search ..... 149/19, 92, 105, 19.2

[56] References Cited

U.S. PATENT DOCUMENTS

| | | | |
|---|---|---|---|
| 2,999,744 | 9/1961 | Eckels | 149/92 X |
| 3,116,189 | 12/1963 | Fisher | 149/92 |
| 3,296,041 | 1/1967 | Wright | 149/92 X |
| 3,321,341 | 5/1967 | Ottoson | 149/105 X |

*Primary Examiner*—Stephen J. Lechert, Jr.
*Attorney, Agent, or Firm*—R. S. Sciascia,; Roy Miller; Lloyd E. K. Pohl

[57] ABSTRACT

An improved plastic-bonded explosive formulation comprising a mixture of HMX, RDX, or DATB and a resin having a silicone backbone which shrinks less and has better thermal stability than those presently known. The formulation was developed for use in advanced missile systems.

3 Claims, No Drawings

PLASTIC BONDED EXPLOSIVE COMPOSITION

GOVERNMENT INTEREST

The invention herein described may be manufactured and used by or for the Government of the United States of America for governmental purposes without the payment of any royalties thereon or therefor.

BACKGROUND OF THE INVENTION

The present invention relates to an improved plastic-bonded explosive.

The currently available plastic bonded explosives, although adequate for many applications, are limited in thermal stability to around 300° F. In full scale detonation studies they yield about the same jet velocities, jet patterns and over pressures as the well-known Composition B, a British developed composition during the period between World Wars I and II and which was standardized by the United States in World War II. It has been a desirable and worthwhile goal to improve the plastic bonded types and still retain the desirable physical properties of Composition B. The present formulation provides an explosive with improved thermal stability, shrinkage, and crack resistance over those currently known. It is the general object of this invention to provide an improved explosive for missile warheads which can be cast in larger dimensions and which does not crack during production.

SUMMARY

The present invention incorporates a resin having a silicone backbone with the high explosive HMX (cyclotetramethylenetetranitramine) in a ratio of about 15 to 30 percent by weight silicone resin and from 70 to 85 percent by weight explosive. Other high explosives such as RDX (cyclotrimethylenetrinitramine) and DATB (diaminotrinitrobenzene) may be used. This formulation provides an improved explosive which resists shrinking and cracking when subjected to aerodynamic heating caused by external carriage on a high performance aircraft. It can be cast in many sizes and will not crack during production.

The preferred silicone resin is of the ethyl silicate type sold under the tradename "Sylgard" by Dow Corning. It is a transparent room-temperature curing, solventless silicone resin designed for potting, filling, embedding and encapsulating and is supplied as a nearly colorless, free-flowing, low viscosity fluid. Its specific gravity at 25° C. is 1.02 and its viscosity at 25° C. is from 4000 to 6500 centipoises. As supplied it is a light straw color and is 100% silicone resin. Sylgard curing agent (polymethylsiloxane) is supplied with the Sylgard resin. Just prior to use, the two are blended in a ratio of about 10 parts resin to 1 part of the curing agent, by weight, whereby curing proceeds by a silane addition mechanism.

The following examples will better illustrate the present invention but should not be construed as limiting the invention which is properly delineated in the appended claims.

EXAMPLE I 45 grams of the binder material, Sylgard, which is a resin with a silicone backbone of the ethyl silicate type, i.e.

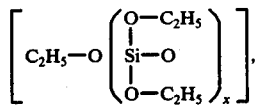

were added to a slurry kettle and 255 grams of HMX (cyclotetramethylenetetranitramine) were mixed in for about 35 minutes until a homogeneous mixture resulted. The mixture was then cast with vibration to avoid air pockets into preforms and cured to a solid material. This sample represents a percentage of the preferred composition of 15% by weight silicone resin of the ethyl silicate type and 85% by weight HMX. The physical properties are as follows:

| | |
|---|---|
| Density | 1.67 g/cc |
| Autoignition Temperature | 248° C. |
| Detonation Velocity, m/sec | 7760 |
| Shrinkage | 0.2% or less |

Other batches were prepared containing from 20 to 30% by weight Sylgard and from 70 to 80% HMX. The Sylgard and HMX were mixed together in a slurry kettle, then a curative for Sylgard, a polymethyl siloxane, was added and the ingredients mixed partly under vacuum. The explosive mix was then poured into a warhead under vacuum and vibration to obtain void free castings.

Other explosive ingredients such as RDX (cyclotrimethylenetrinitramine) which is cheaper than HMX, and DATB (diaminotrinitrobenzene) may be used; also aluminum.

The following table compares the properties of the present improved castable plastic bonded explosive with two other explosives being used.

TABLE I

Properties of Plastic Bonded HMX

| Properties | Sylgard-HMX | PBXN-101 Polyester-HMX | PBXC-113 Plasticized Polyester-HMX |
|---|---|---|---|
| Autoignition Temperature ° C. | 248 | 237 | 242 |
| Cycling to 300° F. (Time in hours) held | 10 | 3 | 10 |
| % Density loss | 0 | 0.06 | 1.0 |
| Density g/cc | 1.67 | 1.67 | 1.70 |
| Detonation Velocity m/sec | 7760 | 7900 | 8060 |
| % Shrinkage | 0.2 or less | 2 | 1 – 1.5 |
| .Bolt cracking test | No cracks | cracks | slight cracks |

The table shows by comparison that the plastic-bonded formulation described herein provides an explosive with little shrinkage and good crack resistance in addition to other properties as good or better than those being used.

Obviously many modifications and variations of the present invention are possible in the light of the scope of the above teachings. It is therefore to be understood that within the scope of the appended claims the invention may be practiced otherwise than as specifically described.

What is claimed is:

1. An improved plastic bonded explosive formulation comprising

| Ingredients | Percent by weight |
|---|---|
| High explosive | 70 to 85 |

-continued

| Ingredients | Percent by weight |
|---|---|
| Binder | 15 to 30 |

said high explosive being a member selected from the group consisting of cyclotetramethylenetetranitramine, cyclotrimethylene-trinitramine and diaminotrinitrobenzene; and said binder consisting of a mixture of about 10 parts ethyl silicate type silicone resin and about 1 part polymethylsiloxane.

2. The formulation as set out in claim 1 wherein the explosive is cyclotetramethylenetetranitramine.

3. The formulation of claim 1 wherein the explosive consists of 85 percent by weight cyclotetramethylenetetranitramine and 15 percent by weight said binder.

* * * * *